US005208561A

United States Patent [19]

Delestre et al.

[11] Patent Number: 5,208,561

[45] Date of Patent: May 4, 1993

[54] LOAD FOR ULTRAHIGH FREQUENCY THREE-PLATE STRIPLINE WITH DIELECTRIC SUBSTRATE

[75] Inventors: Xavier Delestre, Paris; Thierry Dousset, St. Gratien, both of France

[73] Assignee: Thomson-CSF, Puteaux, France

[21] Appl. No.: 813,666

[22] Filed: Dec. 27, 1991

[30] Foreign Application Priority Data

Dec. 27, 1990 [FR] France ..... 90 16329

[51] Int. Cl.[5] ..... H01P 1/26

[52] U.S. Cl. ..... 333/22 R; 333/246; 333/227

[58] Field of Search ..... 333/22 R, 219, 219.1, 333/246, 227, 228

[56] References Cited

U.S. PATENT DOCUMENTS

| | | | |
|---|---|---|---|
| 2,399,930 | 5/1946 | Keister | 333/22 F |
| 3,209,284 | 9/1965 | Hast | 333/22 R |
| 3,509,495 | 4/1970 | Morton | 333/22 R |
| 3,654,573 | 4/1972 | Graham | 333/22 R |
| 3,678,417 | 7/1972 | Ragan et al. | 333/22 R |
| 3,974,462 | 8/1976 | Fassett | 333/22 R |
| 4,197,545 | 4/1980 | Favaloro et al. | 343/700 MS |
| 4,494,083 | 1/1985 | Josefsson et al. | 333/246 |
| 4,513,266 | 4/1985 | Ishihara | 333/246 X |
| 4,727,342 | 2/1988 | Ishikawa et al. | 333/219.1 |

FOREIGN PATENT DOCUMENTS

| | | | |
|---|---|---|---|
| 0040567 | 11/1981 | European Pat. Off. . | |
| 2813586 | 3/1978 | Fed. Rep. of Germany . | |
| 0077304 | 5/1983 | Japan | 333/246 |
| 0111101 | 4/1990 | Japan | 333/22 R |
| 0879826 | 10/1961 | United Kingdom . | |

*Primary Examiner*—Robert J. Pascal
*Assistant Examiner*—Seung Ham
*Attorney, Agent, or Firm*—Oblon, Spivak, McClelland, Maier & Neustadt

[57] ABSTRACT

A load for a stripline integrated into a three-plate structure is formed by a resonant cavity filled with absorbent material. The resonant cavity is defined by metallized holes extending through the three plates. The holes are spaced no more than ¼ wavelength apart and can extend along the length of the stripline to form an opening of the resonant cavity. The structure of the load allows its size to have the same height and width of the stripline.

8 Claims, 1 Drawing Sheet

FIG.1
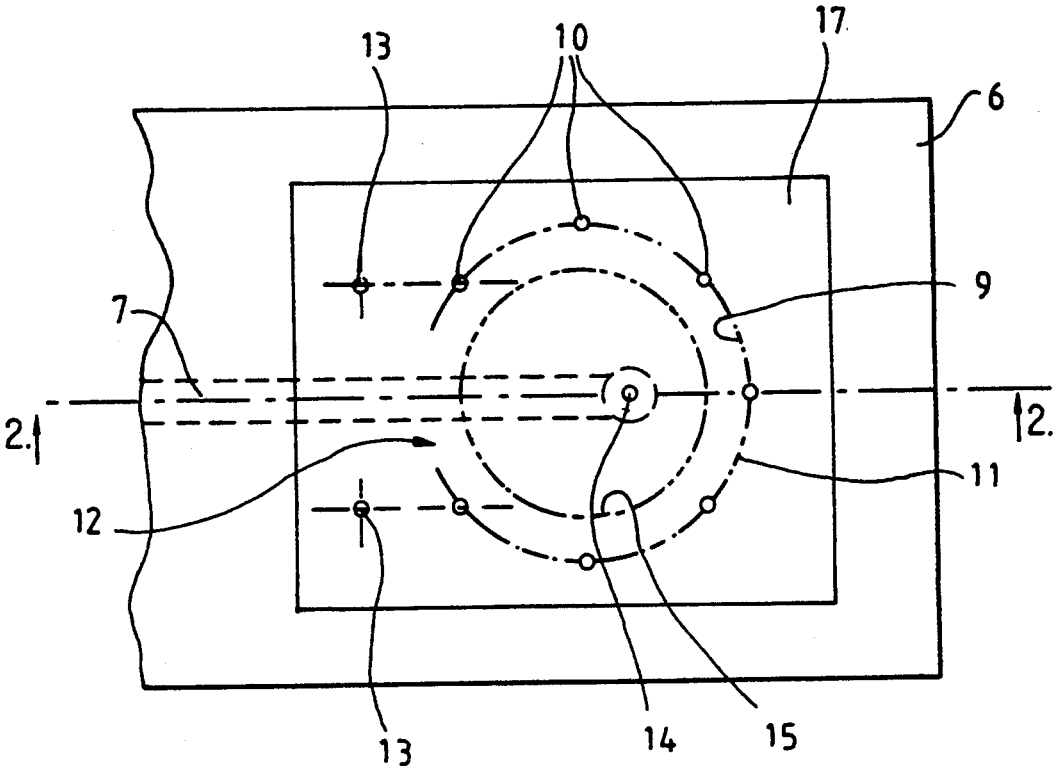
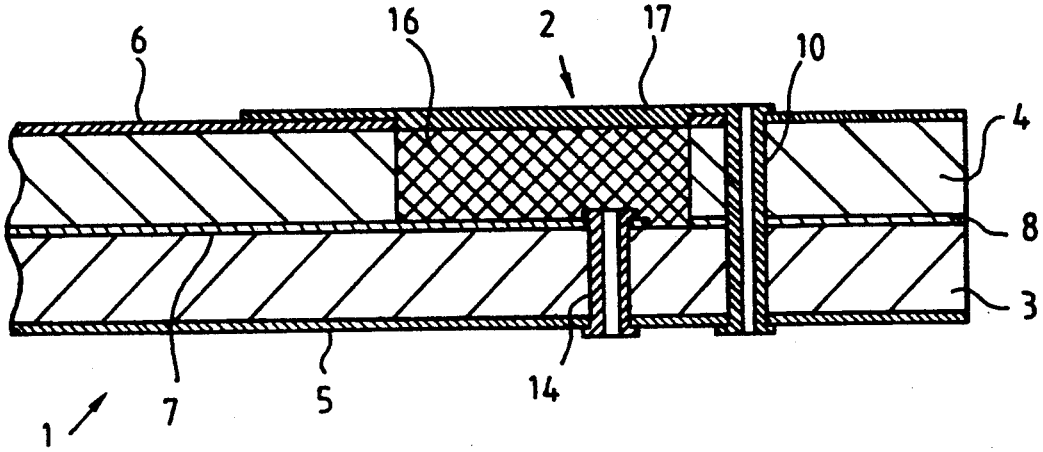
FIG.2

LOAD FOR ULTRAHIGH FREQUENCY THREE-PLATE STRIPLINE WITH DIELECTRIC SUBSTRATE

BACKGROUND OF THE INVENTION

1. Field of the Invention

This invention relates to a load for an ultrahigh frequency three-plate straightline with a dielectric substrate.

2. Discussion of the Invention

Ultrahigh frequency energy distribution circuits are, for example, used to feed network antennas. These distribution circuits comprise an input and N outputs, and are generally made in three-plate technology. One of the possible solutions for making these distribution circuits comprises N-1 hybrid rings inserted in meander lines (to make these circuits compact). The uncoupled output of each hybrid ring is connected to a suitable load. When the antenna comprises a large number of radiating elements (elementary antennas), the number N is high, and the distribution circuit therefore comprises a large number of loads. In addition, this distribution circuit is often assembled mechanically, for example by bonding with other circuits of equivalent dimensions, themselves consisting of several superposed layers of dielectric material that is metallized or not.

To be able to reduce the outside dimensions of the distribution circuit, it is necessary, in particular, that the suitable charges themselves be of reduced dimensions, in occupied surface and also in thickness. More precisely, to be able to insert the distribution circuit inside a multilayer structure, it is necessary that the loads be totally integrated into the thickness of the three-plate circuit, because local excess thicknesses are incompatible with an assembly by bonding.

To solve this problem, loads enclosed in metal packages and added to the multilayer structure could be used, which necessitates making local cuts in the three-plate circuit. This solution is incompatible with assembly by bonding of the two dielectric layers of the three-plate circuit. Actually, it necessitates a connection by soldering of the load to the central conductor of the line and an electrical connection by contact of the metal package with the two ground planes of the three-plate.

Another solution would consist in making each load using a series resistor obtained by the etching of a thin resistive film placed between the dielectric material and the metallization of the substrate. A third solution would consist in forming the series resistor by silk screen printing, the resistive material, which appears initially in the form of ink, being polymerized after being deposited on the circuit. For these last two solutions, one end of the series resistor is connected to the ground planes of the three-plate structure with metallized holes. However, these last two solutions are no longer suitable. The second solution can be used only for circuits of reduced dimensions or stiffened with a metal sole because of the fragility of the currently available resistive film, which runs the risk of exhibiting microruptures. The third solution can be used in a three-plate circuit only if the resistive deposit has reproducible characteristics that are stable over time, which is very difficult to attain.

SUMMARY OF THE INVENTION

This invention has as its object a load for a dielectric three-plate stripline, which is of reduced dimensions, entirely integrated into the thickness of the three-plate circuit and simple and economical to produce.

The load according to the invention comprises a resonant cavity made in the thickness of at least one of the dielectric substrates of the three-plate, excited by the end of the three-plate stripline to which it is connected, and filled at least partially with an absorbent material.

BRIEF DESCRIPTION OF THE DRAWINGS

The invention will be better understood on reading the detailed description of an embodiment, taken by way of nonlimiting example and illustrated by the accompanying drawing, in which:

FIG. 1 is a plan view of a three-plate structural part comprising a load according to the invention, and FIG. 2 is a view in section along II—II of FIG. 1.

DESCRIPTION OF THE PREFERRED EMBODIMENTS

The invention is described below with reference to an ultrahigh frequency distribution circuit load, but it is well understood that it is not limited to such an application, and that it can be used in any three-plate structure.

Three-plate structure 1 in which load 2 of the invention is formed essentially comprising a lower dielectric substrate 3 and an upper dielectric substrate 4. Substrate 3 is metallized on its lower face 5, and upper substrate 4 is metallized on its upper face 6.

The central conductors of the three-plate structure are formed, for example, on the upper face of lower substrate 3. End 7 of one of these conductors, to which load 2 must be connected, has been represented in the drawing. Substrates 3 and 4 are assembled mechanically by bonding. For this purpose, a thermofusible film 8, for example, is used.

To delimit resonant cavity 9 in structure 1, metallized holes 10 are made in it. These holes lo pass through the entire three-plate structure, and connect lower metallized surface 5 to upper metallized face 6. These holes 10, for example, are placed on a circle such as circle 11 shown in FIG. 1, an opening 12 being made in this circle around the end of line 7 to form the entrance of cavity 9. Additional metallized holes 13 delimit opening 12. Metallized holes 10, for example, are equidistant and spaced a distance D that is less than $\frac{1}{4}$ wavelength.

The end of line 7 penetrates at least somewhat into cavity 9 (delimited by circle 11 with metallized holes), for example to at least a half-radius of circle 11. In the present case, the end of line 7 is connected to lower metallized face 5 by a metallized hole 14, thus forming an excitation loop (current loop) of cavity 9. However, it is well understood that the end of line 7 is not necessarily connected to a ground plane (5 or 6).

In the substrate, on the inside of circle 11, a hole 15 is made which is, for example, circular and concentric to circle 11 and with a diameter less than that of circle 11, this hole being, for example, made in the entire thickness of substrate 4. This hole 15 is filled with an absorbent material 16. This material 16 is selected so as to exhibit considerable dielectric losses at the wavelength used. Preferably, this material 16 comprises a mixture of dielectric material and metal particles. According to an example of embodiment, it is composed of epoxy resin and powdered iron. It can be machined in the form of a pellet of the same thickness as dielectric layer 4, and inserted into hole 15, or it can be molded directly in hole 15, then shaved to the level of the metallization 6. Of course, metallized hole 14 can be made in substrate 4, and hole 15 in substrate 3, or in fact, the hole for the absorbent material can be made in both substrates 3 and 4, a "bridge" of substrate 3 or 4 existing to support the end of line 7 and, if necessary, to form metallized hole 14.

When material 16 is in place in hole 15, the ground plane of layer 5 (and/or of layer 6) is reconstituted with an additional metallization 17 covering holes 10 and 13, preferably by performing a reload, localized or not, of electrolytic copper.

The dimensions of cavity 9, the number of holes 10 which delimit it, the dimensions and characteristics of absorbent material 16, are determined as a function of the frequency of use, of the energy to be dissipated, and of the dielectric constant of the substrates 3 and 4.

The load of the invention exhibits the following advantages.

suitability is obtained for a very broad frequency band (more than 2 octaves);

its bulk is reduced (diameter of hole 16 less than 8 mm in band X, for example);

three-plate circuit 1 can easily be integrated into a multilayer structure (the excess thicknesses due to holes 10, 14 and to layer 17 are insignificant);

production is simple and not very costly;

the heating of the absorbent material, due to the power which is dissipated is drained off easily by ground plane (6) to which it is connected;

the losses by spurious propagation (TE mode) in the three-plate circuit are slight (about −30 dB in band X for said example).

We claim:

1. A load for high frequency three-plate stripline, comprising:

a three-plate stripline having outer plates and a conductor disposed therebetween;

metallized holes spaced a maximum of ¼ wavelength apart extending through the outer of the stripline and defining a resonant cavity therein;

an end of the conductor between the outer plates of the stripline extending into and terminating in the resonant cavity;

an electrically absorbent material inside of the resonant cavity between the outer plates of the stripline and connected to the end of the conductor.

2. A load for a high frequency three-plate stripline according to claim 1, wherein:

the end of the conductor is connected by a metallized hole to one of the outer plates of the stripline.

3. A load for a high frequency three-plate stripline according to claim 1 wherein:

the electrically absorbent material comprises a mixture of dielectric material and metal particles.

4. A load for a high frequency three-plate stripline according to claim 1, wherein the electrically absorbent material has a thickness which is the same as a distance between one of the plates and the conductor.

5. A load for a high frequency three-plate stripline, comprising a three-plate stripline having outer plates and a conductor disposed therebetween:

metallized holes extending through the outer plates of the stripline and forming a circular resonant cavity around an end of the conductor in the stripline, the resonant cavity having an opening where the conductor enters into the resonant cavity and further having metallized holes extending through the outer plates along a length of the conductor thereby defining the opening to the resonant cavity which extends away from the circular resonant cavity; and an electrically absorbent material inside of the resonant cavity between the outer plates of the stripline and connected to the end of the conductor.

6. A load for a high frequency three-plate stripline according to claim 5, wherein:

the end of the conductor is connected by a metallized hole to one of the outer plates of the stripline.

7. A load for a high frequency three-plate stripline according to claim 5, wherein:

the electrically absorbent material comprises a mixture of dielectric material and metal particles.

8. A load for a high frequency three-plate stripline according to claim 5, wherein:

the electrically absorbent material has a thickness which is the same distance between one of the plates and the conductor.

* * * * *